United States Patent [19]

Sheppard

[11] 4,166,620

[45] Sep. 4, 1979

[54] FINGERTIP HOCKEY GAME

[76] Inventor: John J. Sheppard, 15446 SE. 142nd Pl., Renton, Wash. 98055

[21] Appl. No.: 794,148

[22] Filed: May 5, 1977

[51] Int. Cl.[2] ..... A63F 3/00

[52] U.S. Cl. ..... 273/126 R; 273/85 R; 273/127 B

[58] Field of Search ..... 273/126 R, 127 R, 127 A, 273/127 B, 85 R, 85 A, 85 B, 85 C, 85 D, 118 R, 118 A, 118 D, 108, 119 R, 119 A, 6

[56] References Cited

U.S. PATENT DOCUMENTS

| | | | |
|---|---|---|---|
| 458,516 | 8/1891 | Bullen | 273/126 R |
| 961,714 | 6/1910 | Chase | 273/126 R |
| 1,144,112 | 6/1915 | Denny | 273/30 |
| 1,593,421 | 7/1926 | Blum | 273/85 R |
| 2,969,985 | 1/1961 | Batt | 273/85 R |
| 3,121,391 | 2/1964 | Fletcher | 273/126 R |
| 3,704,887 | 12/1972 | Thorton | 273/29 R |
| 3,734,504 | 5/1973 | Breslow | 273/126 R |
| 4,032,150 | 6/1977 | Wilson | 273/126 R |

*Primary Examiner*—Richard C. Pinkham
*Assistant Examiner*—T. Brown
*Attorney, Agent, or Firm*—Delbert J. Barnard

[57] ABSTRACT

Two players take turns propelling a puck, by flicking it with a fingertip, over the surface of a playing board towards the other player's goal. The playing board is boarded by an outer wall which provides carom surfaces at the perimeter of the playing board and a pair of goals in the nature of openings in such outer wall. A plurality of short inner wall sections are arranged on the playing surface to provide both additional carom surfaces and a labyrinth path for the puck. In one embodiment the inner wall sections are movably mounted onto the playing board. A two-position goal attachment, engageable with the outer wall, is provided for each goal. In one position the attachment forms a closure for the goal. In the other position it forms a collector for the puck after it passes through the goal.

8 Claims, 11 Drawing Figures

Fig. 4
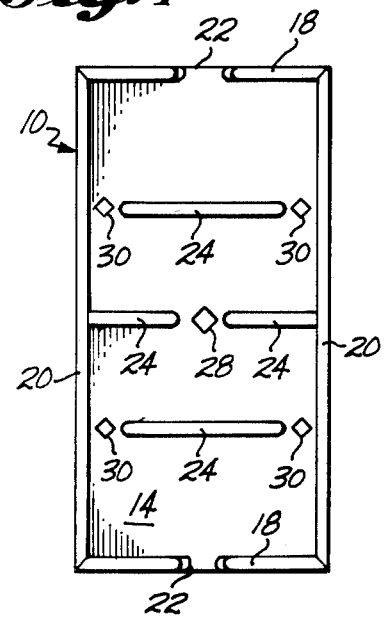
Fig. 5
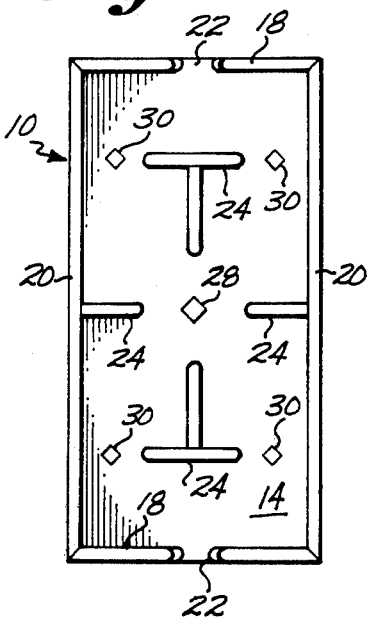
Fig. 6
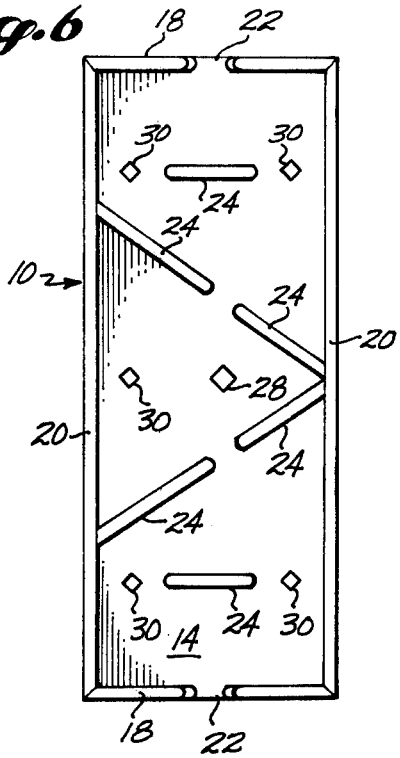
Fig. 7
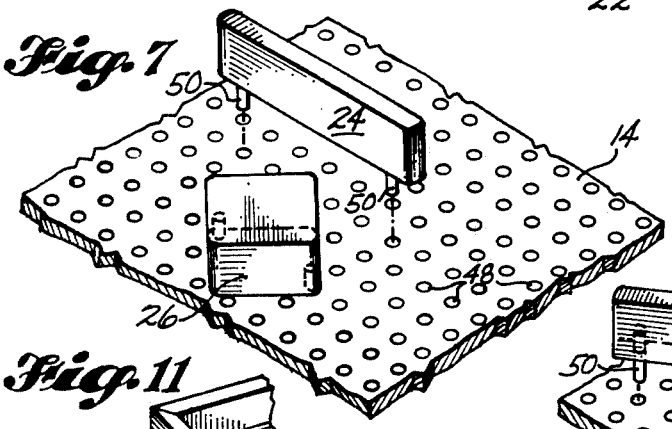
Fig. 8
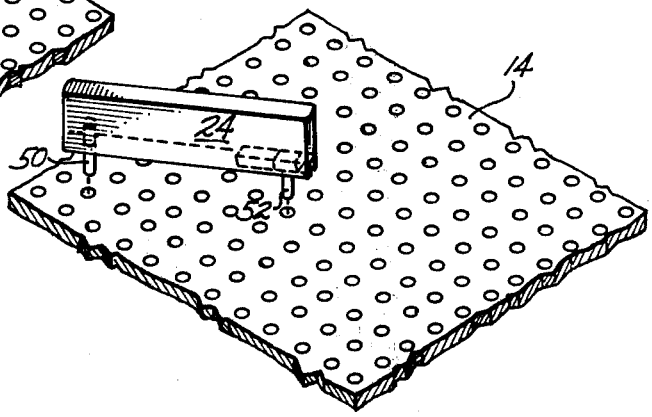
Fig. 11
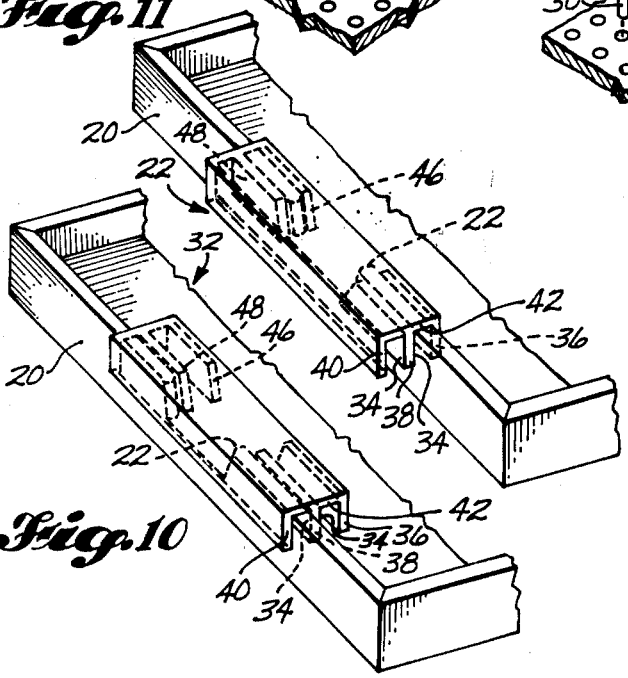
Fig. 10
Fig. 9
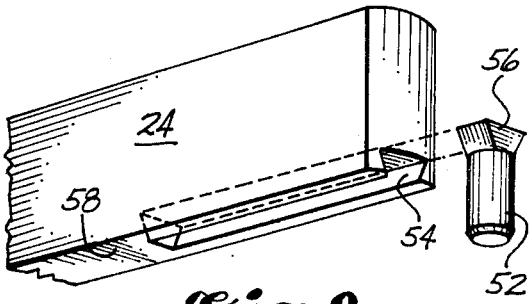

FINGERTIP HOCKEY GAME

BACKGROUND OF THE INVENTION

1. Field of the Invention

The fingertip hockey game of the present invention relates to the art of table top games played on a flat, smooth surfaced playing board. More particularly, it relates to such games utilizing a puck which is propelled across the surface of the playing board through a pattern of obstacles before reaching one of the goals located at each end of the playing board.

2. Description of the Prior Art

Table top playing boards are, of course, generally old in the art. U.S. Pat. No. 2,824,739 issued Feb. 25, 1958 to Frank discloses the general concept of a table top playing board having a smooth, flat playing surface surrounded by a raised rim. A puck is provided in the form of a small, thin, flat, circular disc. The puck is propelled across the surface of the playing board by striking it with a paddle towards a plurality of goals located at opposing ends of the game board. The technique of caroming the puck off the side walls is also disclosed. The game is played by each player in turn making five shots at the opposing goals from behind his respective lag line.

U.S. Pat. No. 499,073 issued June 6, 1893 to Williams discloses a similar game apparatus which includes a pattern of upstanding wickets and playing piece holes arranged on the surface of the playing board. Here the player is required to move the puck either through or around the wickets, and if desired, the puck may be caromed off the wickets and sides during play. However, because of the thin, wire-like nature of the wickets, caroming the playing piece off them in a planned fashion is nearly impossible.

U.S. Pat. No. 1,504,605 discloses a different form of playing board in which the playing surface is perforated by a plurality of holes adapted to receive the mounting pin which projects from the base of each cylindrical man and goal post. The plurality of holes allows the men and goal posts to be positioned on the board as desired. Again, the playing piece may be caromed off either the men or the goal posts, but because of their cylindrical character, precision shots are again not possible.

BRIEF SUMMARY OF THE INVENTION

In basic form, the fingertip hockey game of the present invention comprises a playing board having a top, playing surface which is smooth and flat. An outer wall surrounds the board and defines a pair of apertures which serve as goals at two opposing ends of the board. A plurality of inner wall means are secured to the surface of the playing board and serve as both obstacles and as rebound surfaces off which the thin, flat circular playing piece or puck may be accurately caromed.

Further aspects of the present invention specify the playing board to be rectangular and the goals to be located on the longitudinal axis thereof.

Other aspects of the present invention require the inner wall means to be disposed on the playing surface of the board in such a manner that the central portion of the playing surface is left vacant and at least one inner wall means will prevent a straight shot from the central portion of the playing surface through the goals.

Another aspect of the present invention includes a removable trap located at each end of the playing board straddling each goal. The removable trap is placed over the end wall of the game board and may be moved beween a first, compact, storage position and a second, playing position in which it will stop the puck after it passes through its respective goal.

Other aspects of the present invention specify that at least one of the inner wall means is detachably mounted to the playing board by means of downardly projecting pegs. At least one of these pegs is longitudinally movable with respect to its inner wall means to provide a spacing between the pegs such that they may be inserted into corresponding apertures which may be provided in the playing surface for this purpose.

It is an object of the present invention to provide an inexpensive, easily constructed table top game particularly suited for mass production.

A further object of the present invention is to provide a simple, yet challenging game which requires a maximum of skill and ingenuity in order to successfully manipulate the puck through the maze of inner wall means provided on the surface thereof.

Another object of the present invention is to provide a game particularly adapted to train the coordination and skill of a young or handicapped person by requiring him to manipulate a puck through a maze of inner wall means.

A further object of the present invention is to provide a game which requires the successful user to practice and perfect the technique of accurately caroming the puck off both the side walls and the inner wall means in order to best score a goal.

Another object of the present invention is to provide a game in which the inner wall means are adapted to be removably secured to the playing surface to thereby enable the player to change the pattern of inner wall means at his desire. Such a construction results in elimination of boredom caused by repetitious maneuvering of the puck through the same maze of inner wall means, and enables the user to make the particular maze of inner wall means easier or harder as he requires.

A further object of the present invention is to provide a trap at each goal to stop the pucks passing therethrough. Further, each trap is specified to be selectively mountable so that it may be conveniently stored, when the game is not in use, in a manner which practically insures the prevention of the trap's inadvertent loss.

BRIEF DESCRIPTION OF THE DRAWING

FIG. 4 is a top plan view of the game shown in FIG. 1;

FIGS. 5 and 6 are top plan views of alternative embodiments of the game shown in FIG. 1;

FIG. 7 is a pictorial representation of an alternative method of mounting two forms of inner wall means on the surface of the game board;

FIG. 8 is a view similar to that of FIG. 7 showing an inner wall means with a movable mounting peg;

FIG. 9 is a detailed, pictorial representation of the mortise and tenon construction of the inner wall means shown in FIG. 8;

FIG. 10 is a fragmentary pictorial representation of a goal end of the game board shown in FIG. 1 which includes a removable trap in a storage position; and FIG. 11 is a view similar to that of FIG. 10 showing the trap in a playing position.

DESCRIPTION OF THE PREFERRED EMBODIMENTS

It is known that games requiring physical skill and coordination exhibit a particular fascination for nearly everyone. Such games are exceptionally popular and exciting because the result depends not upon luck or chance but upon the abilities of the user. Thus, the fingertip hockey game of the present invention is designed to whet the appetite and challenge the user to exercise his skill, judgment and coordination to the fullest possible extent.

However, interestingly enough, applicant devised the fingertip hockey game of the present invention to serve as more than a mere amusement device. Applicant is a professionally trained educator who deals with those children exhibiting mental or emotional handicaps to a moderate degree. During his work, he discovered that it would be useful if he could provide a dual purpose device which could not only be offered as a reward for good behavior but which would also, as an inescapable conjunct, simultaneously improve their mental, visual and physical coordination. In his search of devices presently on the market, applicant was unable to discover a device which adequately fulfilled these requirements. As a result, applicant was forced to invent a device which would meet his needs, and his efforts resulted in the fingertip hockey game of the present invention.

Figure 1:
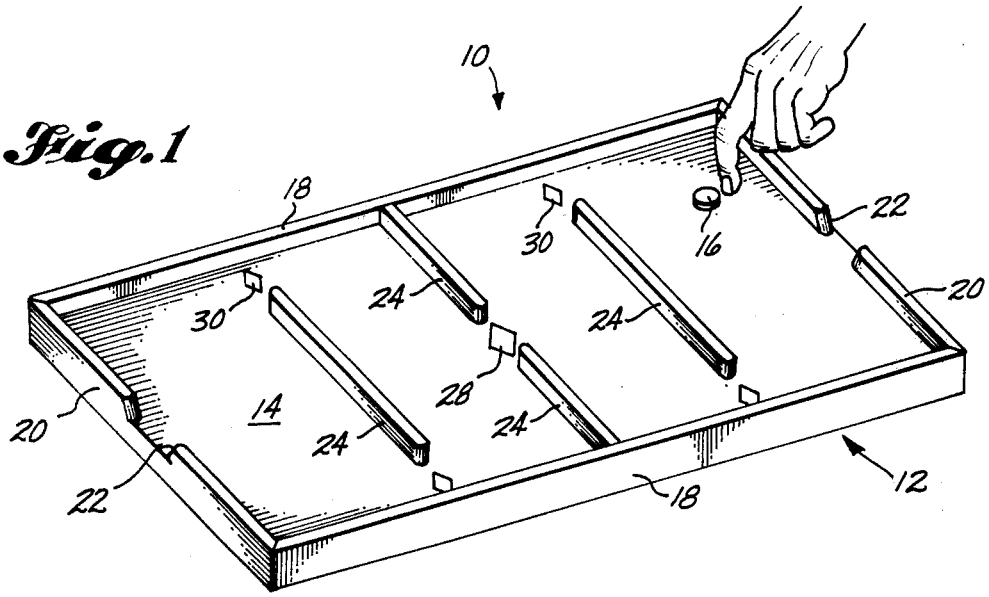
FIG. 1 is a perspective view from an upper aspect of the fingertip hockey game of the present invention.

Referring now to FIG. 1, the fingertip hockey game of the present invention comprises a playing board 10 which is bordered by an outer wall, generally designated at 12. The playing board may be formed from any of a variety of materials such as masonite, wood, plastic or the like. An essential requirement is that its top, playing surface 14 be flat, smooth and hard so as to offer as little resistance as possible to the playing piece or puck 16 which travels over it.

The outer wall comprises two side walls 18 and two end walls 20 all of which are fabricated from relatively thin strips of wood, plastic or other suitable material which are secured to the playing board by gluing, molding, nailing or the like. Each side and end wall extends upwardly above the playing surface 14 for a moderate distance in order to contain the puck 16 during use. Additionally, they provide a flat rebound surface off which the puck may be caromed, to enable the user to more quickly score a goal. A goal 22 is provided in each end wall 20 and comprises an aperture formed therein which is centered on the longitudinal axis of the playing board 10. Of course, each goal need not be so located, but could be positioned anywhere in the outer wall including the sides 18.

A pattern of inner wall means are arranged across the playing surface 14 and may be secured thereto as by gluing, stapling or the like. As seen in FIG. 7, each such inner wall means may comprise a thin strip 24, or a polygon 26 formed from wood, plastic or the like. The essential quality is that at least one inner wall means have at least one flat rebound surface off which the puck may be accurately caromed during play. Consequently, it is understood that the strip 24 and polygon 26 forms of the inner wall means are shown merely by way of example, and many other forms will occur to those skilled in the art. Similarly, a mixture of forms of inner wall means is within the scope of the present invention, and some of the inner wall means may be selected to have no flat rebound surface at all. In addition, to enhance easy storage and to prevent breakage of the inner wall means, the height of each inner wall means is selected to be the same as or less than the height of the outer wall 12.

Referring now to FIGS. 4–6, we see that the arrangement and location of the inner wall means, here strips 24, may be varied to a considerable extent to thereby control the difficulty of the game. Thus applicant has found from use, that of the three embodiments of the present invention illustrated in these figures, the easiest maze is presented by the inner wall means illustrated in FIG. 4. The mazes of inner wall means illustrated in FIGS. 5 and 6 are each considered to be more difficult to navigate than that illustrated in FIG. 4, with the maze of FIG. 6 more difficult than that of FIG. 5. It is seen that the length and the positioning of the inner wall means can be varied almost infinitely without departing from the spirit of the present invention. Further, the inner wall means are not required to be either parallel or perpendicular to the outer wall, but may lie at an angle with respect thereto as is shown in FIG. 6, for example.

In addition, to aid in mass production, it is within the scope of the present invention that the playing board 10, including the outer wall 12 and the inner wall means be molded of plastic as a unit.

It will be noted that in all of the embodiments of the present invention shown in FIGS. 4–6, the mazes of inner wall means have certain common features. Among these are that the starting point or face off mark 28 is located approximately in the center of the playing board 10, and thus the central portion of the playing surface 14 is left vacant in order to facillitate the beginning of play. Further, it will be noted that in all embodiments shown in FIGS. 4–6 the inner wall means are so arranged that a clear shot from the face off mark to the goals is not possible. Instead, the arrangement of the inner wall means on each game board shown is such that each player is practically forced to carom the puck off the inner wall means, the side walls and the end walls in order to make maximum progress towards the goal during his turn. Thus, a challenging game with high interest is provided which requires a maximum of skill and coordination.

As is seen in FIGS. 4–6 the playing board is generally rectangular and its size may vary. Thus, the playing boards shown in FIGS. 4 and 5 are approximately 2 feet by 1 foot with the playing board shown in FIG. 6 being approximately 2½ feet by 1 foot. Of course, other shapes of the playing board are possible and, in general, a playing board in the form of any polygon is within the scope of the present invention. Naturally, the position of the face off mark(s) 28 and the goals 22 need not be located as shown in FIGS. 4–6, but may be positioned at different locations according to the particular design of the playing board.

In addition, as an aid to figuring his shots, the present invention may include the use of gauge marks 30 located on the playing surface 14 at suitable locations to enable the user to more accurately set up his shots. Of course, the location of the gauge marks on the playing surface will depend on the particular arrangement of inner wall means utilized, as seen, for example, in FIGS. 4–6.

As shown in FIGS. 10 and 11, a trap 32 is provided for each goal 22. The trap is movable between two positions: a compact, storage position, shown in FIG. 10, and a playing position, shown in FIG. 11. The trap is generally in the form of a rectangular parallelepiped having two longitudinal slots 34 of a U-shaped cross section. Each trap comprises first, second and third generally vertical, spaced apart, longitudinal trap walls 36, 38, 40, respectively, which are secured together by an overlying top wall 42. It is seen that the adjacent first and second walls 36, 38 define co-extensive, aligned apertures 46, 48 of substantially the same size as the goal. The spacing of the walls 36, 38, 40 is such that the outer wall 12 will fit relatively snugly into each slot 34 so that the trap may be carried by the outer wall in both the playing and storage positions.

Each trap 32 may be formed from a suitable material such as wood or plastic by routing the slots 34 from a solid piece of material and then cutting out the apertures 44, 46 in the first and second walls 36, 38. Alternatively, each trap may be formed by gluing together thin strips of material in a manner that would be apparent to those skilled in the art.

As is seen in FIG. 10, when the trap 32 is placed over the end wall 20 so that the second and third trap walls 38, 40 bound the end wall, the goal 22 is blocked by unapertured trap wall 40. Thus, during storage or transportation the puck 16 will not be lost through the goal. Further, it is seen that in this position the trap forms a quite compact arrangement with the playing board 10. This compact size is clearly a marked benefit, since the trap is less likely to be lost or broken when stored in this position, and less space is required to store the game of the present invention when it is not in use.

As seen in FIG. 10, when playing the trap 32 is placed over the end wall 20 so that the first and second trap walls 36, 38 bound the end wall. In addition, the trap is positioned so that the apertures 44, 46 in the first and second trap walls are aligned with the goal. In this position, it is seen that the trap will now allow the puck to pass unimpeded through the goal while the unapertured third wall 40 serves as a form of net or screen which will stop the puck after passing through the goal so that it falls conveniently at the end of the game board.

Turning now to FIG. 7, an alternative form of the playing board 10 is shown which includes a plurality of apertures 48 in the playing surface 14, so that the playing surface assumes a pegboard like form. Such a playing board 10 may be formed by drilling an array of apertures 48 in the playing surface as shown in FIG. 7, or by preparing a smooth, hard, flat surface on any of the many commercially available pegboard materials.

As is seen, one or more inner wall means, such as the strip 24, is provided with mounting pegs 50 which are spaced apart a distance equal to the distance between a pair of apertures 48. To mount the strip 24 on the playing surface, its mounting pegs are simply inserted into convenient, matching apertures 48 which are sized to snugly receive them. However, when the apertures 48 are aligned to form a rectilinear array it is apparent that when the mounting pegs 50 are spaced a distance equal to the spacing between the apertures 48 in a given horizontal or vertical row of apertures 48, the strips 24 cannot be positioned diagonally with respect thereto and thus the number of patterns of strips which may be arranged on the playing surface is relatively limited.

As seen in FIGS. 8 and 9, to overcome this difficulty at least one moveable mounting peg 52 is provided on at least one inner wall means, such as strip 24, so that strip 24 may be positioned diagonally, as well as horizontally and vertically, with respect to the rectilinear array of apertures 48 in the playing surface. As is seen, a mortise 54 of generally trapezoidal cross section 15 is cut or formed in the bottom portion 58 of the strip 24, and is sized to snugly receive the matching tenon 56 on the top of moveable mounting peg 52. Such a mortise and tenon construction is preferred over a simpler, pure friction fit since the mortise and tenon construction provides a physical locking mechanism which prevents the moveable peg from becoming disengaged from its inner wall means when the inner wall means is pulled up out of the playing board 10. Many similar arrangements will occur to those skilled in the art for providing a means by which at least one of the mounting pegs may be made movable, and applicant has shown his preferred form in FIGS. 8 and 9.

In use, one merely places one mounting peg 50 of the strip 24 of FIG. 8 over one of the apertures 48 and then aligns the strip 24 in the position desired. The other, movable peg 52 is then aligned with a nearby aperture 48, and when in position both pegs 50, 52 may be inserted into their respective apertures 48. It is readily apparent, that this arrangement will greatly enhance the novelty and utility of the present invention inasmuch as when the user becomes bored with a particular arrangement of inner wall means, the game is not discarded, but instead the pattern and arrangement of the inner wall means may be changed to provide a new challenge. Similarly, the pattern of inner wall means may be located so that a relatively easy maze is presented to the young or inexperienced user, with a more difficult maze being constructed as the user becomes more adept.

It is also apparent that the playing board of the present invention may be double sided, with a game on each side, not illustrated. Or, the reverse side may be adapted for some other use, such as a chalk board or the like. In the first event, it is apparent that the outer wall 12 would have to be heightened in order to provide an upstanding board for both sides of the playing board.

Although many ways of playing the game of the present invention are possible, applicant will describe for purposes of illustration one manner in which the game may be played utilizing only one puck 16. The puck 16, as is seen in the figures, comprises a thin, flat disc of any suitable material such as metal, plastic or the like. In fact, applicant has found that a penny will serve admirably as a puck.

Figure 2:
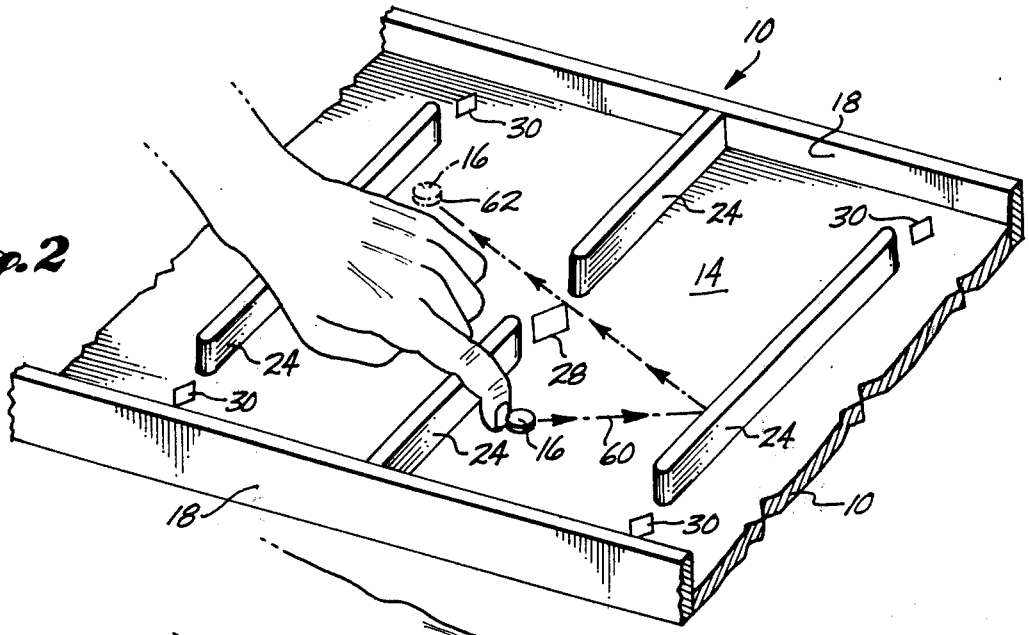
FIGS. 2 and 3 illustrate the manner of manipulating the puck through the pattern of inner wall means.
Figure 3:
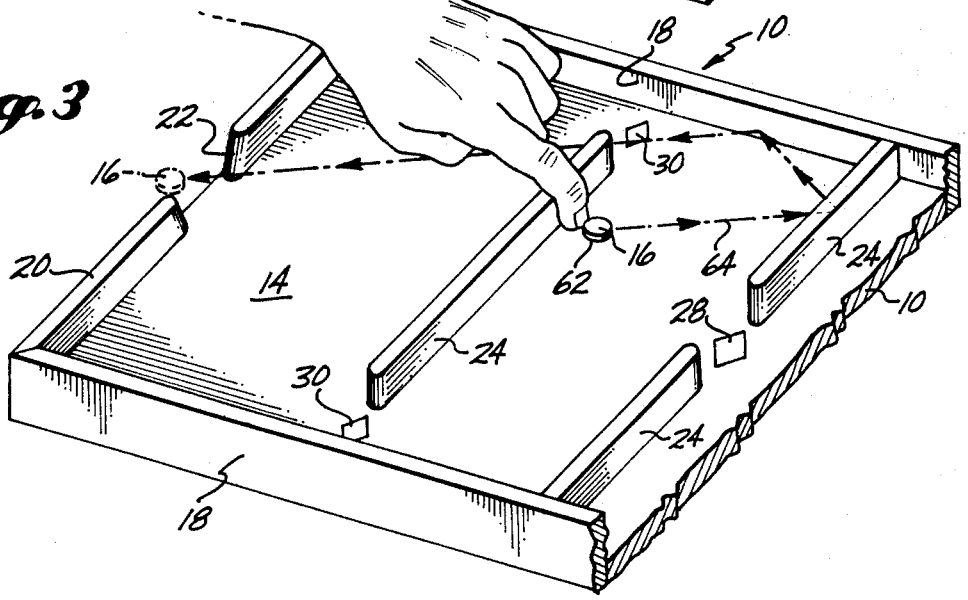

Referring now to FIGS. 2 and 3, the puck is placed over the face off mark 28 on the playing board 10. The first player seeks to flick the puck through his own goal by snapping it with his fingertip or by using a thin strip of material as a paddle. If the first player is not successful in making a goal on his turn, the second player will play the puck from where it lies after the first player's turn. The second player will, of course, try to drive the puck back towards his own goal. The players alternate turns until one of them is successful in making a goal, at which time he scores one point and the game continues as before.

To further illustrate the variety of shots that are possible with the present invention, we now refer to FIGS. 2 and 3 which show the same playing board illustrated in FIG. 1. In FIG. 2, it is seen that the puck has come to rest on the opposing player's half of the playing board. In order to snap the puck towards his own goal, it is apparent that the player will find it necessary to ricochet the puck off one of the inner wall means so that the puck will travel along the line 60 in the direction indicated by the arrows.

In FIG. 3, assuming the player has another turn for purposes of illustration, the puck must now be played from the rest position 62 that was reached in FIG. 2. Here, it is seen that in order to make a goal the player must nicely calculate a combination inner wall means and side wall shot in order to cause the puck to travel the line 64 in the direction shown by the arrows.

From the foregoing example, it is quite apparent that the present invention provides not only an amusing and challenging game, but also one which demands a considerable amount of mental, visual and physical coordination in order to calculate and execute the shot necessary to put one in a scoring position or to actually score a goal. It is further seen that the present invention is particularly adaptable for providing easy mazes of inner wall means for young or inexperienced players; while still being able to provide much harder mazes for those older players or those who have achieved some degree of skill in the art of playing the game.

From the preceeding descriptions, various further applications, modifications and adaptations of the apparatus disclosed by the foregoing preferred embodiments of the present invention will be apparent to those skilled in the art to which the present invention is addressed, within the scope of the following claims.

What is claimed is:

1. A hockey type board game comprising:

(a) a playing board having a top, playing surface which is smooth and flat, over which a puck is propelled;

(b) a raised outer wall defined by a pair of parallel, spaced apart, opposed end walls and a pair of parallel, spaced apart, opposed side walls secured to and bordering at least a portion of said playing board to both retain said puck on said playing surface and to provide a rebound surface off which said puck may be accurately caromed during play;

(c) a goal located at each of two opposing ends of said playing board and comprising an aperture defined by said end walls and, (d) a plurality of inner wall means disposed on said playing surface and extending substantially parallel to said end walls, with at least one of a pair of said inner wall means being disposed opposite each of said goals such that an open playing surface exists therebetween, and with each one of a pair of said inner wall means having a path disposed around the ends thereof, and another pair of said plurality of inner wall means being disposed on said playing surface between said pair of inner wall means disposed adjacent each of said goals, with said inner wall means intersecting said outer wall at one end thereof and adapted to leave a central area of said playing surface of said game board open whereby a playing piece may traverse said playing surface between said inner end walls without obstruction and, (e) wherein a face-off mark is located on the playing surface at said central area of a board to define a starting position of the puck.

2. The game according to claim 1, wherein at least one inner wall means has substantially the cross section of a polygon.

3. The game according to claim 1, wherein the playing board is rectangular.

4. The game according to claim 3, wherein the goals are located on the longitudinal axis of the playing board.

5. The game according to claim 1, further comprising a plurality of spaced apart gauge marks located on the playing surface in each said path to enable the user to more accurately gauge his shots.

6. The game according to claim 1, wherein at least one of the inner wall means is detachably mounted to the playing board and includes at least two downwardly projecting pegs; and the playing board defines a plurality of spaced apart apertures sized to snugly receive the downwardly projecting pegs.

7. A hockey type board game comprising:

(a) a playing board having a top, playing surface which is smooth and flat, over which a puck is propelled;

(b) a raised outer wall secured to and bordering at least a portion of said playing board to both retain said puck on said playing surface and to provide a rebound surface off which said puck may be accuratedly caromed during play;

(c) a goal located at each of two opposing ends of said playing board and comprising an aperture defined by the outer wall; and, (d) at least one inner wall means disposed on said playing surface to provide an obstacle to block the free travel of said puck across said playing surface and to provide at least one flat, rebound surface off which said puck may be accurately caromed, and wherein said at least one inner wall means is detachably mounted to said playing board and includes at least two downwardly projecting pegs, with said playing board adapted to have a plurality of spaced apart apertures sized to snugly receive said downwardly projecting pegs, and wherein at least one of the pegs is longitudinally movable with respect to its associated inner wall means to thereby enable the spacing between said pegs to coincide with the spacing of at least two of said apertures in said playing board.

8. The game according to claim 7, wherein at least one of the pegs includes a tenon and the detachably mounted inner wall means defines a longitudinally extending mortise sized to receive the tenon; whereby each peg having a tenon may be moved longitudinally with respect to its associated inner wall means to thereby enable the spacing between the pegs to coincide with the spacing of at least two of the apertures in the playing surface.

* * * * *